US008272438B2

(12) United States Patent
Cook et al.

(10) Patent No.: US 8,272,438 B2
(45) Date of Patent: Sep. 25, 2012

(54) SYSTEM AND METHOD FOR ROBUSTLY AND ACCURATELY OBTAINING A PORE PRESSURE MEASUREMENT OF A SUBSURFACE FORMATION PENETRATED BY A WELLBORE

(75) Inventors: John Cook, Cambridge (GB); Marc Thiercelin, Dallas, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 429 days.

(21) Appl. No.: 12/519,226

(22) PCT Filed: Sep. 27, 2007

(86) PCT No.: PCT/GB2007/003661

§ 371 (c)(1),
(2), (4) Date: Aug. 13, 2009

(87) PCT Pub. No.: WO2008/078060

PCT Pub. Date: Jul. 3, 2008

(65) Prior Publication Data

US 2010/0018702 A1 Jan. 28, 2010

(30) Foreign Application Priority Data

Dec. 22, 2006 (GB) ..... 0625727.3

(51) Int. Cl.
*E21B 47/06* (2006.01)

(52) U.S. Cl. ..... 166/250.07; 166/250.11; 166/250.17; 175/50; 73/152.51; 73/152.53

(58) Field of Classification Search ..... 166/250.07, 166/250.11, 250.17; 175/50; 73/152.02, 73/152.12, 152.51, 152.53
See application file for complete search history.

(56) References Cited

U.S. PATENT DOCUMENTS

| | | | | |
|---|---|---|---|---|
| 4,161,782 | A | 7/1979 | McCracken | |
| 5,369,579 | A | 11/1994 | Anderson | |
| 5,467,823 | A | 11/1995 | Babour et al. | |
| 5,934,371 | A | 8/1999 | Bussear et al. | |
| 6,003,620 | A | 12/1999 | Sharma et al. | |
| 6,070,662 | A | 6/2000 | Ciglenec et al. | |
| 6,234,257 | B1 * | 5/2001 | Ciglenec et al. | 175/50 |
| 6,766,854 | B2 | 7/2004 | Ciglenec | |
| 6,896,074 | B2 * | 5/2005 | Cook et al. | 175/50 |

(Continued)

FOREIGN PATENT DOCUMENTS

EP 0882871 A2 12/1998

(Continued)

OTHER PUBLICATIONS

Burgess et al, Wireline-Conveyed Through-Casing Formation Tester Preserves Casing Integrity, SPE Eastern Regional Meeting, Canton, Ohio, Oct. 17-19, 2001, SPE paper 72371.

*Primary Examiner* — Jennifer H Gay

(57) ABSTRACT

Systems and methods are disclosed for accurately determining a pore pressure of a subsurface formation (20) penetrated by a wellbore (40). The systems and methods provide for measuring pressure and temperature at a measuring location proximal to the wellbore for a predetermined amount of time, storing the measurements, communicating the measurements and processing the pore pressure from the pressure and temperature measurements. The measuring location may be a location in a channel (50) drilled from the wellbore into the formation.

12 Claims, 3 Drawing Sheets

U.S. PATENT DOCUMENTS

| | | | | |
|---|---|---|---|---|
| 7,140,434 | B2 * | 11/2006 | Chouzenoux et al. | 166/250.11 |
| 7,261,168 | B2 * | 8/2007 | McGregor et al. | 175/50 |
| 7,380,597 | B2 | 6/2008 | Edwards | |
| 7,779,684 | B2 * | 8/2010 | Meek et al. | 73/152.24 |
| 2002/0195247 | A1 * | 12/2002 | Ciglenec et al. | 166/250.11 |
| 2004/0069487 | A1 * | 4/2004 | Cook et al. | 166/250.01 |
| 2005/0257611 | A1 | 11/2005 | Fogal et al. | |
| 2005/0257960 | A1 * | 11/2005 | McGregor et al. | 175/24 |
| 2006/0005965 | A1 * | 1/2006 | Chouzenoux et al. | 166/250.11 |
| 2008/0115574 | A1 * | 5/2008 | Meek | 73/152.03 |
| 2010/0018702 | A1 * | 1/2010 | Cook et al. | 166/250.07 |

FOREIGN PATENT DOCUMENTS

| | | | |
|---|---|---|---|
| EP | 0882871 | A3 | 5/1999 |
| EP | 0984135 | A2 | 3/2000 |
| EP | 0984135 | A3 | 8/2000 |
| GB | 2405245 | A | 2/2005 |
| GB | 2419923 | A | 5/2006 |
| WO | 9749894 | A1 | 12/1997 |
| WO | 2004033844 | A2 | 4/2004 |
| WO | 2004033844 | A3 | 12/2004 |
| WO | 2006000438 | A1 | 1/2006 |
| WO | 2006005555 | A1 | 1/2006 |

* cited by examiner

SYSTEM AND METHOD FOR ROBUSTLY AND ACCURATELY OBTAINING A PORE PRESSURE MEASUREMENT OF A SUBSURFACE FORMATION PENETRATED BY A WELLBORE

BACKGROUND

Embodiments of the present invention relate to methods and systems for measuring A pore pressure of a subsurface formation surrounding a wellbore penetrating the subsurface formation and, more specifically but not by way of limitation, the methods and systems of such embodiments provide for measuring the pore pressure so as to remove/reduce the interfering effects and/or influences of the wellbore on the pressure being measured. More particularly, but not by way of limitation, in an embodiment of the present invention a pressure sensor and a temperature sensor may be disposed in a channel extending from the wellbore into the subsurface formation, the sensors periodically measure the pressure and temperature of the formation and these measurements are communicated to a processor that processes the periodic measurements of the pressure and temperature in the formation to determine a pore pressure of the formation that is free or substantially free from wellbore influences.

During the production of fluids such as hydrocarbons and/or gas from an underground reservoir, it may be desirable to determine the development and behaviour of the reservoir. Such reservoir determinations may allow production from the reservoir to be controlled and optimized and may also provide for determining how changes to the operation of the wellbore affect or may affect the reservoir. Formation pressure measurement is one measurement that may be made on a formation and used to provide for the management of the reservoir.

When a well is first drilled, it may be relatively easy to accurately measure formation pressure. For example, a probe may be positioned in contact with a borehole wall and used to sense the pressure of fluids or the like in the formation. Such measurement of formation pressure may be made by means of a tool that may be lowered into the wellbore via a wireline cable and pressure measurements may be logged through the well with the tool and cable being removed from the wellbore when measurements are completed. Because such formation-pressure-logging tools may be relatively large and expensive, the tools are not generally left in the wellbore for overly long periods of time.

In a normal wellbore drilling process, the step of completion of the wellbore may be realized by installing a liner or casing into the wellbore. The casing may be made of steel and may be fixed to the wall of the wellbore by a cement that may be disposed in an annulus between the outer surface of the casing and the borehole wall. The casing or liner may provide a physical support to the wellbore to prevent the wellbore collapsing or becoming eroded by flowing fluids. The completion of the wellbore prevents access being made to the formation from the wellbore. As such, one completed, it may be difficult to obtain accurate formation pressure measurements.

Various approaches have been proposed to enable measurements to be made on formations after a well has been completed in the manner described above. These approaches provide for positioning sensors in the formation, but contain many limitations, including but not limited to operation of the sensors, data collection and wellbore influences on data being measured.

U.S. Pat. No. 6,234,257 and U.S. Pat. No. 6,070,662 describe a system and method in which a sensor is disposed inside a shell, which is forced into the formation. This forcing of the shell into the formation is achieved by the use of an explosive charge that is fired while the well is being drilled. According to the reference, the sensor can then be interrogated for an extended period after the drilling is finished by means of an antenna which can communicate through an aperture provided in the casing.

SPE 72371 describes a tool (the CHDT tool of Schlumberger), which may be used with a pressure to provide for pressure testing of a formation after completion of a well. As described in the reference, the tool may be used to drill a hole through the casing and cement into the formation and a probe/sensor may be placed in the wellbore and over the hole to sense the formation pressure and take samples of any formation fluid, if required. Once the measurement is complete, a plug or rivet is placed in the hole in the casing, sealed and pressure tested to confirm the integrity of the casing.

Installation of permanent sensors on the outside of the casing of the wellbore may allow for long term monitoring of formation pressure. However, since cement associated with the casing is usually impermeable, such monitoring would necessitate to some means of fluid communication between the formation and the sensor in order that pressure can be measured. One proposal has been to mount the sensor in a chamber on the outside of the casing that also carried an explosive charge. After installation and cementing, the charge is fired to provide a communication path into the formation. This approach is not preferred in many cases since it requires the use of explosive charges which brings with it safety considerations and extensive complexity for controlling the firing of the charge. The damage caused by the charge might be sufficient to damage the sensor too. Another potential problem is that since the perforation tunnel is not open to the well, fluid does not flow through the perforation and allow cleaning of residues. Therefore there is no way to ensure that there is good fluid communication between the formation and the sensor. Since the charge is mounted on the outside of the casing, it may be necessary to use a smaller casing size than normal to fit into the borehole. Further details of this approach can be found in U.S. Pat. No. 5,467,823.

Furthermore, patent publication Nos. US 2005/0217848, WO 2006/000438 and WO 2006/005555 disclose sensors and methods for disposing such sensors behind the casing of the completed wellbore. The positioning methods including drilling through the casing and cement into the formation surrounding the well so as to create a fluid communication path and sealing the hole drilled in the casing.

While the above mentioned patents and patent applications disclose concepts for obtaining formation pressure in a subsurface formation penetrated by a wellbore they do not identify the problems associated with wellbore influences on the formation pressure or disclose methods and systems for accurately measuring such a formation pressure free of such wellbore influences. Nor do the patents and patents applications consider low permeability formations or disclose how to make an accurate formation pressure measurement in a low permeability formation, such as shale or the like.

BRIEF SUMMARY OF THE INVENTION

Embodiments of the present invention relate to systems and methods for robustly and accurately determining a pore pressure of a subsurface formation penetrated by a wellbore. More specifically, but not by way of limitation, embodiments of the present invention may provide for measuring pressure and temperature at a measuring location proximal to the wellbore for a predetermined amount of time, storing the measurements, communicating the measurements and processing the pore pressure form the pressure and temperature measurements. The measuring location may be a location in a channel drilled from the wellbore into the formation.

As such, in one embodiment a method for determining pore pressure of a low permeability subsurface formation surrounding a wellbore penetrating the low permeability subsurface formation, comprises:

- disposing a temperature and a pressure sensor in a subsurface formation at a measuring location
- using the sensors to measure the pressure and temperature of the subsurface formation at the measuring location
- storing the pressure and temperature measurements
- waiting for a pre-determined period of time
- communicating the stored pressure and temperature measurements to a processor after the determined period of time
- processing a pore pressure of the formation from the pressure and temperature measurements.

In another embodiment, a system is disclosed for measuring pore pressure in a subsurface formation comprising;

- a pressure sensor;
- a temperature sensor, wherein the pressure sensor and the temperature sensor are configured to be disposed in a channel extending from a casing of the borehole into the low permeability subsurface formation;
- a power source coupled with the pressure sensor and the temperature sensor and configured to supply power to the pressure sensor and the temperature sensor;
- a control processor coupled with the power source, the pressure sensor and the temperature sensor and configured to periodically control the power source, the pressure sensor and the temperature sensor to provide that the pressure sensor and the temperature sensor periodically measure a pressure and a temperature in the channel; and
- a memory coupled with the control processor and configured to store the periodically measured pressure and temperature values; and
- an interrogation device deployable in the borehole and configured to communicate with the memory to retrieve the stored pressure and temperature values.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

The present invention will become more fully understood from the detailed description and the accompanying drawings, wherein.

DETAILED DESCRIPTION

Figure 1A:
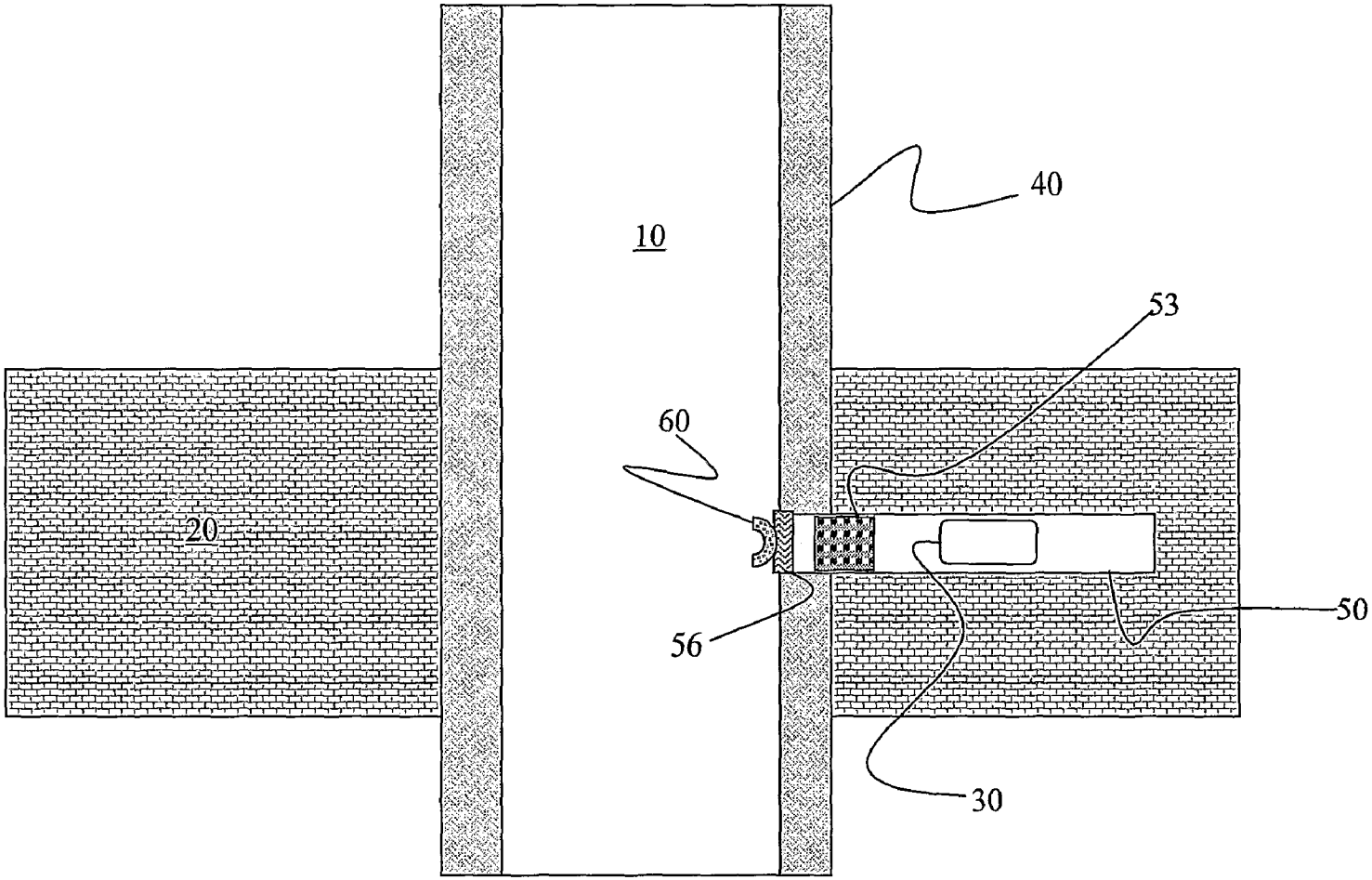
FIG. 1A is a schematic-type illustration of a pressure sensor system disposed in an earth formation surrounding a wellbore for measuring pore pressure of the formation, in accordance with an embodiment of the present invention.

The ensuing description provides preferred exemplary embodiment(s) only, and is not intended to limit the scope, applicability or configuration of the invention. Rather, the ensuing description of the preferred exemplary embodiment (s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Determination of pore pressure may be an integral part of drilling planning and basin modelling. Accurate measurement of the pore pressure may, however, be difficult because of the wellbore casing, the effects of the wellbore and its operation on the pressure of the formation immediately surrounding the wellbore and/or the like. Robust sensor systems may also be problematic because of isolation of the sensors, powering of the sensors, control of the sensors at a remote location and/or the like. Moreover, because of the difficulty of measuring pore pressure in formations with low permeabilities, such as shale (10-8 to 10-11 Darcy), methods based for estimating the pore pressure of such formations have been developed based on such things a porosity trend analysis and are embodied in algorithms such as Eaton's Method and in software packages such as Schlumberger's RockSolid software.

Genuine validation of these approaches is extremely difficult since there are no downhole measurements of pore pressure in a shale to compare the estimated results with. As such, kick pressures, which occur when reservoir fluids flow into the wellbore when the wellbore pressure is less than that of the formation fluids, may be taken as calibration points for shale pressure profiles derived for drilling planning; these correspond to the fluid pressures in permeable zones embedded within the shale, and so are valid and useful for drilling purposes. The procedure does, however, require that a kick has taken place in the wellbore, which is fortunately a rare event, and one that drillers strive to avoid.

With regard to shale, there may be at least five underlying reasons as to why accurately measuring pore pressure in a subsurface formation of the shale around a wellbore may be problematic:

(a) The permeability of the shale is so low that it takes a very long time to move sufficient fluid through the formation to fill any free space around a pressure transducer, pressurize the transducer and then activate the transducer. For conventional pressure transducers, the timescale for this is of the order of months or years, so laboratory measurements of shale pore pressure use miniature transducers, and experimental designs with very small dead volumes;

(b) The flow rates into the measuring volume are so small that any leakage from higher-pressure regions, or into lower pressure regions, seriously distorts the measurement;

(c) Changes in any stress acting on the shale may lead to pore pressure changes (some of the stress change is borne by the fluid rather than the solid skeleton of the rock); these are transient, but the low permeability of the rock means that their timescale is days or weeks rather than the (fractions of) seconds expected in a normal rock;

(d) Changes in the chemical environment of the shale can induce changes in the nature of the shale and its fluid pressure, for example, drilling fluid chemistry can drive water (and ions) in or out of the borehole wall in a shale; and (e) Temperature has a major effect on the pore pressure of the shale. This is because the thermal expansion of water is larger than that of the shale and constituent minerals so a 1° K change in temperature may cause a 1 MPa change in shale pore pressure. As such, if a region of shale within a formation is heated, its pore pressure will rise and then fall as fluid leaks into the rest of the formation—the timescale of this fall of the pore pressure, however, may be very long.

With regard to wellbore influences on the pore pressure that may be measured outside but proximal to the wellbore, subsurface formation flow from or into the uncased wellbore may act like a leak, which, although very small, may influence, especially inn the case of a low permeability formation such as shale, the pressure transducer, and may provide that it does not read the far-field pore pressure. Also, when the wellbore is drilled, the stresses around the wellbore may change and, consequently, the pore pressure of the formation around the wellbore may also changes; these changes may decay on a timescale of the order of days or weeks. Furthermore, when the well is drilled, the fluids associated with the drilling process may interact with the formation(s) surrounding the wellbore and may cause changes in pressure in the formation(s) that may be transient, but long-lived. Finally, the temperature of the wellbore may change in response to every operation or process taking place in the wellbore and, as a result, the temperature at any pressure measurement point within the formation may be influenced by several or many diffusions of heat into or out of the rock and, likewise, the pressure at these measurement points may be affected by the temperature fluctuations.

FIG. 1A is a schematic-type illustration of a pressure sensor system disposed in an earth formation surrounding a wellbore for measuring pore pressure of the formation, in accordance with an embodiment of the present invention. In an embodiment of the present invention, a pressure sensor system 30 may be used to measure pore pressure in a subsurface formation 20 surrounding a wellbore 10 penetrating the subsurface formation 20. The sensor system 30 may be disposed in the subsurface formation 20 behind a casing 40 of the wellbore 10. In certain aspects, the casing 40 may comprise a metallic liner cemented to a face of the formation.

The sensor system 30 may be positioned behind the casing 40 by various methods including being placed in the formation through a perforation in the casing 40, being positioned in the formation before the casing 40 is installed or the like. In certain embodiments of the present invention, a cased hole drilling tool ("CHDT") may be used to drill a conduit 50 that extends from the wellbore 10, through the casing 40 into the subsurface formation 20. In certain aspects, the conduit 50 may extend a distance of the order of 0.1 m to 1 m into the subsurface formation 20. The length of the conduit 50, the distance along the conduit 50 where the sensor system 30 is disposed and/or the like may be determined for use in processing outputs from the sensor system 30, modeling conditions experienced by the sensor system 30 and/or the like.

In an embodiment of the present invention, the sensor system 30 may be protected, isolated and/or the like from the wellbore 10 and/or the contents of the wellbore 10 by an isolation material 53. In some aspects, the isolation material may comprise a nonporous material that may be disposed in the conduit 50 between the sensor system 30 and the wellbore 10. Additionally or in place of the isolation material, the hole in the casing 40 may be plugged with a sealing plug 56. The sealing plug 56 may be a metal-on-metal sealing plug for sealing with a metal casing of the wellbore 10. In an embodiment of the present invention, the conduit 50 may be configured to be in fluid communication with the subsurface formation 20.

The sensor system 30 may comprise a pressure transducer for measuring the pore pressure. The sensor system 30 may be coupled with a transmitting device 60, which may be an antenna or the like. The transmitting device 60 may be a device that is capable of transmitting information from the sensor system 30 into the wellbore 10 where the information/data may be received by a receiver (not shown) and communicated to a processor (not shown) or the like that may be disposed in the wellbore 10 or at a surface location. The transmitting device 60 may also have the capability to receive energy that may in turn be used to provide for powering or partial powering of the sensor system 30. For example, the transmitting device 60 may be capable of receiving electromagnetic radiation or the like and converting/using for powering the sensor system 30. In certain aspects, the pressure transducer may be configured or the conduit 50 may be configured to provide that the pressure transducer fits the conduit 50 as closely as possible. In other aspects, a material may be disposed into the conduit 50 to provide for coupling between the pressure transducer and the subsurface formation 20 for measurement of the pore pressure.

In some embodiments of the present invention, the sensor system 30 may comprise a small pressure transducer, with small dead volume. To provide that the sensor system 30 is a small system for easy disposal, the sensor system 30 may comprise a Micro-Electro-Mechanical System ("MEMS"). In certain aspects, for low permeability formations, a pressure transducer with an accuracy of the order of 0.1 MPa (14.5 psi) may be used. Putting the sensor system 30 behind the casing 40 may prevent bulk leakage to or from the wellbore 10 to the measuring/sensing point. Additionally, sealing plug 56 and/or the isolation material 53 may prevent or reduce interference of wellbore fluids or wellbore temperatures with the sensor system 30. Where the sealing plug 56 is a metal-to-metal plug effects, such as diffusion that may occur in rubber type plugs/seals or in some forms of packers, may be prevented.

The sensor system 30 may be installed as soon as the cement associated with the casing of the wellbore 10. As such, the sensor system 30 may be positioned before the wellbore 10 is completely drilled and cased providing a period of time before completion of the wellbore 10 for equilibration of pressure changes caused by the stress concentration. Furthermore, the wellbore can continue to be used without interference from the transducer. In certain aspects, the measurement point may be placed as far away from the wall of the wellbore 10 as possible, for example, at the end of the CHDT hole, in order to provide for reduction of the stress effects in the subsurface formation 20 caused by the wellbore 10; since such stress effects decay with distance from the wellbore 10.

The sensor system 30 may collect temperature and pressure data in the conduit 50 and store the measurements that are made in a database or the like. After a period of time, a well-tool or the like (not shown) may be introduced down the wellbore 10 to interrogate the sensor system 30. Interrogation of the sensor system 30 may be via wireless communication, which may be wireless acoustic communication, wireless electromagnetic communication and/or the like. After interrogation of the sensor system 30, the well-bore tool or the like may be retrieved to a surface location for communication with a processor or may communicate through the wellbore 10 to the processor to provide that the pressure and temperature data collected by the sensor system 30 may be processed.

Chemically induced changes in the subsurface formation 20 caused by the wellbore 10 and/or the fluids associated with the wellbore 10 may also decay with distance from the wellbore 10. In some embodiments of the present invention, to minimize the effects of chemistry, the drilling fluid used for frilling the wellbore 10 may be selected so as to reduce invasion into the subsurface formation 20.

The casing 40 may not present a barrier to temperature changes that may be caused in the subsurface formation 20 and at the measuring location by temperature changes in the wellbore 10 that may result from operations being carried out in the wellbore 10. However, in an embodiment of the present invention, the sensor system 30 may comprise a temperature sensor to determine the temperature at the pressure measurement point. In an embodiment of the present invention, the temperature measured by the temperature sensor may be used to correct a pressure measurement made at the pressure measurement point for thermally induced pressure changes.

In certain aspects, correction of the pressure measurement for thermally induced pressure changes may be processed from the temperature at the pressure measuring point and the undisturbed temperature of the formation, that is the formation temperature free of wellbore influences. In certain embodiments of the present invention, provided the other perturbations have been allowed to decay, the far-field pore pressure, i.e. the actual pore pressure of the subsurface formation 20, may be determined by the sensor system 30 when the temperature sensor records a temperature at the pressure measurement point that is equivalent to the undisturbed formation temperature. However, because the wellbore and formation temperatures, cannot, in general, be controlled, in an embodiment of the present invention, the sensor system 30 may be periodically energized and pressure and temperature at the measurement location measured and recorded and these measurement may then be processed to determine a temperature at which the pressure measurement point is equivalent to the undisturbed formation temperature.

In an embodiment of the present invention, the sensor system 30 may be installed during construction of the wellbore 10 and then left for a period of time to equilibrate and collect data. In certain aspects of the present invention, the period of time the sensor system 30 is left before activation may be estimated from an approximate knowledge of the properties of the subsurface formation 20. Such analysis of the period before interrogating the sensor system 30 may provide for an estimation as to when transient pressure perturbations have died away. Additionally, in certain aspects of the present invention, a record of the well operations, modeling of temperature at the measuring location resulting from wellbore operations and/or the like may be processed to determine when or if the temperature at the measurement point has passed though the undisturbed formation temperature one or more times so that an accurate pore pressure may have been recorded by the sensor system 30.

In an embodiment of the present invention, after the period of time for pressure perturbations to decay and/or the temperature at the pressure measurement point to have passed through at least once been equivalent to the undisturbed formation temperature has elapsed, the sensor system 30 may be interrogated. As discussed above, the interrogation unit may be a wireline-conveyed tool and the tool may provide for powering up the non-acquisition electronics in the sensor system 30 via inductive coupling.

In an embodiment of the present invention, from a pressure-temperature-time profile downloaded from the sensor system 30 the extent of the decay of pressure transients may be analysed and the temperature at the measuring point may also be analysed. If the analysis of the decay of pressure transients and/or the temperature at the measuring point is found to in a satisfactory range, the far-field pressure pore pressure may be processed from the pressure and temperature logs. If the analysis of the decay of pressure transients and/or the temperature at the measuring point is found not to be in a satisfactory range, i.e. pressure perturbation decay has not proceeded as far as is needed, another interrogation of the sensor system 30 may be needed for an accurate pore pressure measurement to be determined. In certain aspects, a determination as to when to next interrogate the sensor system 30 may be made on the basis of the recorded data.

Figure 1B:
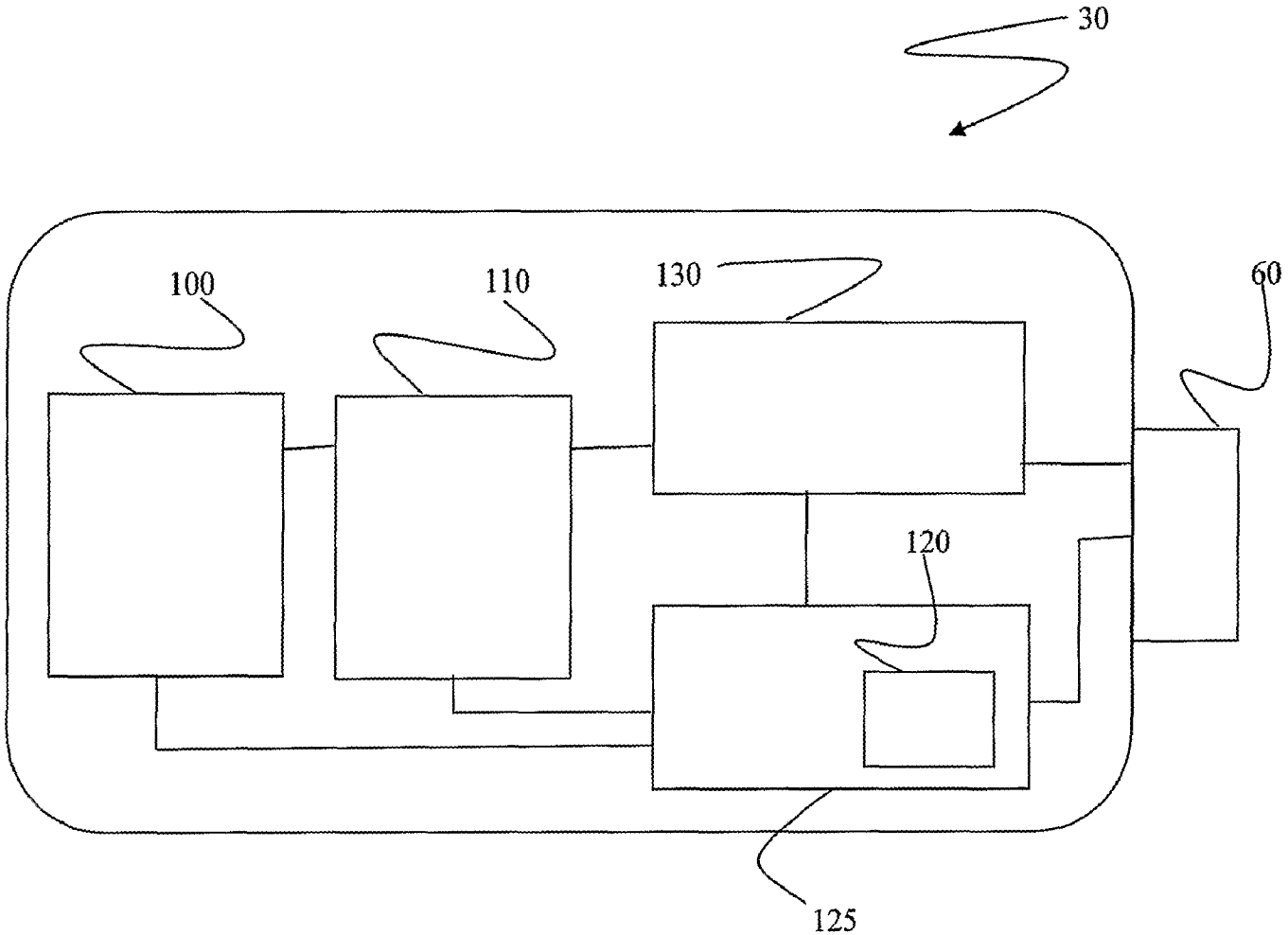
FIG. 1B is a schematic-type illustration of the pressure sensor system of FIG. 1A, in accordance with an embodiment of the present invention.

FIG. 1B is a schematic-type illustration of the pressure sensor system of FIG. 1A, in accordance with an embodiment of the present invention. In an embodiment of the present invention, the sensor 30 comprises a pressure transducer 100 for measuring pressure of the formation at the measuring location where the sensor system 30 is disposed. The pressure transducer 100 may be a MEMS, a silicon based pressure transducer, a solid state transducer and/or the like and in certain aspects may be pressurized in the measuring location. The sensor system 30 also comprises a temperature sensor 110, which may in certain aspects be a thermocouple, a thermistor and/or the like.

In some embodiments of the present invention, a power supply 130 may provide for powering the a pressure transducer 100 and the temperature sensor 110. The power supply 130 may comprise a battery or the like. In certain aspects, the power supply 130 may comprise an energy harvester. In various embodiments of the present invention, energy harvesting systems, such as system based on pressure, thermal-electric principles and/or the like may be used. In some aspects, energy may be sent along or to the energy harvester. For example, transducers may be used and energy such as pressure waves or the like may be sent to the transducer for conversion and supply to the sensor system 30. Power may be generated by the energy harvesting systems and in certain aspects may be accumulated in suitable storage devices, e.g. super-capacitors or the like, for use when required. This stored/harvested energy may be applied to the sensor system during required data acquisition and telemetry periods.

In one embodiment of the present invention, the sensor system 30 may comprise an operation processor 125. The operation processor 125 may control the power supply 130 and the operation of the pressure transducer 100 and the temperature sensor 110. In an embodiment of the present invention, because of the period of time over which pressure measurement may be needed to be made to ensure influences of the wellbore do not affect the pressure measurement and temperature affects at the measuring point may be analyzed and corrected for, the operation processor 125 may be configured to operate the power supply 130, the pressure transducer 100 and the temperature sensor 110 periodically. This periodic operation may, among other things, reduce power requirements of the sensor system 30.

The operation processor 125 may provide that pressure and temperature measurements obtained by the sensor system 30 are recorded in a memory 120. The memory 120 may be a database or the like. The transmitting device 60 may be configured with the operation processor 125 to provide for communication of the stored pressure and temperature measurements to a wellbore communication system so that the measurements may be transmitted to the surface for processing. In certain aspects, inductive coupling, radio frequency transmission and/or the like may be used to send power to the sensor system 30.

Figure 2:
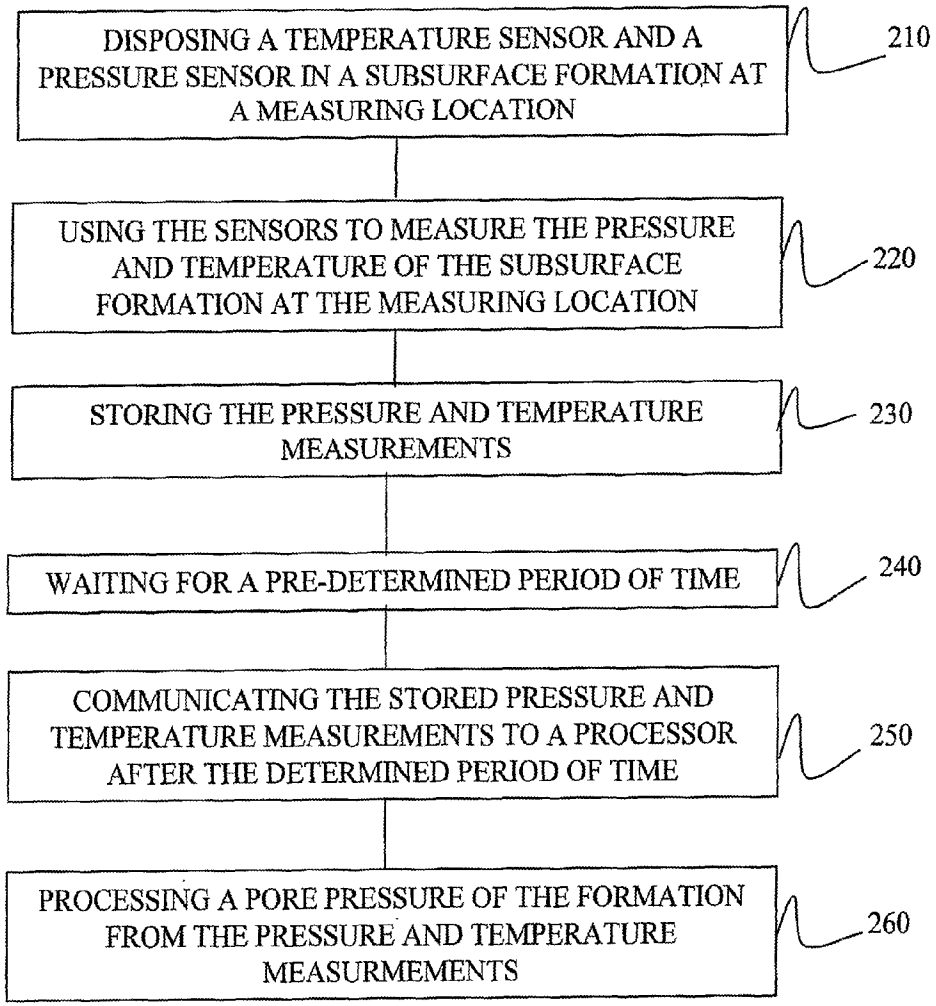
FIG. 2 is a flow-type schematic illustrating a method of determining pore pressure of a formation surrounding a wellbore, in accordance with an embodiment of the present invention.

FIG. 2 is a flow-type schematic illustrating a method of determining pore pressure of a formation surrounding a wellbore, in accordance with an embodiment of the present invention. In step 210, a combination of a temperature sensor and a pressure sensor are disposed in a subsurface formation at a measuring location. In one embodiment of the present invention, the measuring location is proximal to a wellbore penetrating the subsurface formation. In certain aspects, the measuring location is a distance behind a casing of the wellbore. The distance may be in the range of fractions of meters to meters into the subsurface formation from the wellbore casing.

To dispose the sensors at the measuring location, in certain embodiments of the present invention, a channel may be drilled extending out from the wellbore, through the wellbore casing and into the subsurface formation. The sensors may then be disposed in the drilled channel. In certain aspects a seal may be used to isolate the channel from the wellbore. The seal may be a metal-on-metal plug that seals to a metal casing of the wellbore. In other aspects, packers or the like may be used to seal the channel. Additionally, material may be placed in the channel to provide for further isolation of the sensors from the wellbore. Material may include substances with properties similar to the surrounding formation.

In embodiments where a channel is drilled to provide for positioning the sensors in the formation, the size of the channel and/or the size of the sensors may be selected to provide for a snug fit for the sensors in the channel. Material may also be disposed around the sensors to provide for communication between the sensors and the surrounding formation. The sensors may be MEMS sensors, solid state sensors and/or the like. The sensors may be coupled with a power supply to provide for powering the sensors. The power supply may be a battery, a capacitative system and/or the like. The power supply may be coupled with an energy transducer that may provide for harvesting energy from the temperature of the formation or the temperature of the wellbore, receiving energy directed to the energy transducer, such as in the form of radio frequency radiation provided from a device located in the wellbore, from pressure waves directed to the measuring location through the channel from a point in the wellbore, from inductive coupling with a device located in the wellbore and/or the like. A power supply cable or the like may be disposed in the channel to provide for power communication between the sensors and the wellbore. In such situations, sealing material may be used to provide a seal around the power supply cable to prevent fluid or gaseous communication between the wellbore and the sensors. A power cable/conduit may be preformed into a sealing material at the surface and this unit may be disposed into the drilled channel to provide for minimal manipulation downhole.

In step 220, the sensors may be used to measure the pressure and temperature of the subsurface formation at the measuring location. In some embodiments, a control processor may control the sensors to provide that measurements are only taken at periodic intervals. In certain aspects, the control processor may control the taking of measurements based upon the temperature measured by the temperature sensor. In other aspects, the control processor may control the taking of measurements based upon the pressure measured by the pressure sensor. In such methods, the taking of measurements by the sensors may be controlled and, among other things, the use of power by the sensors may be managed.

In step 230, the pressure and temperature measurements may be stored. The measurements may be stored in a database, in a memory associated with the control processor and/or the like. In certain aspects, the control processor may determine which measurements to store based upon processing of the measurements or the like.

In step 240, the sensors may take measurements for a pre-determined period of time. The pre-determined period of time may be determined based upon the length of time that pressure perturbations may occur at the measuring response due to the drilling of the wellbore, operation of the wellbore and/or the like. The pre-determined period of time may also be determined from the amount of time necessary for the temperature at the measuring location to have equaled, at least once, the temperature of the subsurface formation free of influences from the wellbore. In either determination of the period of time or in combinations of the determinations, the period of time may be determined from modeling, previous results from the same or a similar formation, experimentation and/or the like. Previous and/or undergoing activities in the wellbore may be considered in determining the pre-determined period of time.

In step 250, after the period of time has expired, the stored pressure and temperature measurements may be communicated to a processor. Communication with the processor may involve communication from the sensors and/or the control processor to a device disposed in the wellbore. Such communication may occur via a communication interface in the wellbore, such as an antenna or the like that is capable of communicating with the sensors, control processor and/or a device in the wellbore. The communication interface may be positioned inside of the casing in the wellbore. The device may store the communicated data and be carried to the surface to download data to the processor. In other aspects, telemetry or the like may be used to communicate the data through the wellbore or the wellbore annulus to the processor. Communication between the sensors and/or the control processor and the device or communication portal in the wellbore may be wireless in nature, such as radio frequency communication, acoustic communication, optical communication and/or the like.

In step 260, the processor may process the pressure and temperature measurements to determine a pore pressure of the formation. Such processing may involve correcting pressures made at the measuring location for pressure influences caused by the temperature of the measuring location relative to the temperature of the formation uninfluenced by the wellbore, determining pressure at the measuring location when the measuring location is at the same temperature as the formation as uninfluenced by the wellbore and/or the like. By taking measurements of pressure and temperature for the pre-determined period of time and/or by waiting for the pre-determined period of time to elapse before recovering stored pressure and temperature measurements, embodiments of the present system provide for accurate determinations of pore pressure of the formation free of wellbore influences, elimination or reduction in retrieval of nonviable data, reduced energy requirements at the measuring location and/or the like.

In the foregoing description, for the purposes of illustration, various methods and/or procedures were described in a particular order. It should be appreciated that in alternate embodiments, the methods and/or procedures may be performed in an order different than that described. It should also be appreciated that the methods described above may be performed by hardware components and/or may be embodied in sequences of machine-executable instructions, which may be used to cause a machine, such as a general-purpose or special-purpose processor or logic circuits programmed with the instructions, to perform the methods. These machine-executable instructions may be stored on one or more machine readable media, such as CD-ROMs or other type of optical disks, floppy diskettes, ROMs, RAMs, EPROMs, EEPROMs, magnetic or optical cards, flash memory, or other types of machine-readable media suitable for storing electronic instructions. Merely by way of example, some embodiments of the invention provide software programs, which may be executed on one or more computers, for performing the methods and/or procedures described above. In particular embodiments, for example, there may be a plurality of software components configured to execute on various hardware devices. Alternatively, the methods may be performed by a combination of hardware and software.

Hence, while detailed descriptions of one or more embodiments of the invention have been given above, various alternatives, modifications, and equivalents will be apparent to those skilled in the art without varying from the spirit of the invention. Moreover, except where clearly inappropriate or otherwise expressly noted, it should be assumed that the features, devices and/or components of different embodiments can be substituted and/or combined. Thus, the above description should not be taken as limiting the scope of the invention, which is defined by the appended claims.

What is claimed is:

1. A method for determining pore pressure of a subsurface formation surrounding a wellbore penetrating the subsurface formation, comprising:

disposing a temperature sensor and a pressure sensor in a channel, wherein the channel extends from a casing of the wellbore into the subsurface formation;

using an impermeable seal to separate the measuring location from the wellbore, the impermeable seal configured to prevent fluids flowing into the channel from the borehole;

disposing a pressure sensor and a temperature sensor in the subsurface formation at a measuring location in the channel, wherein the measuring location in the channel is behind the casing of the wellbore;

using the pressure sensor and the temperature sensor to measure a pressure and a temperature of the subsurface formation at the measuring location in the channel, wherein the pressure and the temperature of the subsurface formation are measured at the measuring location in the channel over a pre-determined period of time or after the pre-determined period of time, and wherein the pre-determined period of time is longer than a decay time of pressure perturbations caused by the drilling of the wellbore or production of hydrocarbons from the wellbore;

storing the pressure and temperature measurements;

communicating the stored pressure and temperature measurements to a processor; and processing a pore pressure of the subsurface formation from the pressure and temperature measurements.

2. The method of claim 1, wherein the pre-determined period of time is selected to provide that a measuring location temperature of the measuring location in the channel is equal to an uninfluenced formation temperature at least once during the pre-determined period, and wherein the uninfluenced formation temperature comprises a temperature of the subsurface formation free of any effects of the drilling of wellbore.

3. The method of claim 1, wherein the pressure sensor and the temperature sensor periodically measure the pressure and the temperature of the subsurface formation at the measuring location over the pre-determined period of time or after the predetermined period of time.

4. The method of claim 1, wherein a control processor processes measurements from at least one of the pressure sensor and the temperature sensor to determine when to take the pressure and the temperature measurements.

5. The method of claim 1, further comprising providing for fluid communication between the subsurface formation and at least one of the pressure sensor and the temperature sensor.

6. The method of claim 1, wherein the step of communicating the stored pressure and temperature measurements to the processor comprises wirelessly communicating the pressure and temperature measurements to a device in the wellbore.

7. The method of claim 1, further comprising powering the pressure sensor and the temperature sensor with a power source.

8. The method of claim 7, wherein the power source harvests energy.

9. The method of claim 7, wherein the power source receives energy from an external device.

10. The method of claim 1, further comprising using drilling fluids to drill the wellbore that are configured to provide for low invasion of the drilling fluids into the subsurface formation.

11. The method of claim 1, wherein the step of processing the pore pressure of the subsurface formation from the pressure and temperature measurements comprises correcting one or more of the pressure measurements for a temperature differential between the temperature measurement corresponding to the one or more pressure measurements and an uninfluenced subsurface formation temperature, and wherein the uninfluenced subsurface formation temperature is a temperature of the subsurface formation free of influences from the wellbore.

12. The method of claim 1, wherein the step of processing the pore pressure of the subsurface formation from the pressure and temperature measurements comprises determining a value of the pressure measurement that corresponds to a time when the measuring location is at a temperature equal to that of the subsurface formation free of influences from the wellbore.

* * * * *